US007563331B2

(12) United States Patent
Petzold et al.

(10) Patent No.: US 7,563,331 B2
(45) Date of Patent: Jul. 21, 2009

(54) METHOD FOR PRODUCING NANOCRYSTALLINE MAGNET CORES, AND DEVICE FOR CARRYING OUT SAID METHOD

(75) Inventors: Jörg Petzold, Bruchköbel (DE); Volker Kleespies, Jossgrund (DE); Hans-Rainier Hilzinger, Langenselbold (DE)

(73) Assignee: Vacuumschmelze GmbH & Co. KG, Hanau (DE)

( * ) Notice: Subject to any disclaimer, the term of this patent is extended or adjusted under 35 U.S.C. 154(b) by 321 days.

(21) Appl. No.: 10/472,065

(22) PCT Filed: Jul. 11, 2002

(86) PCT No.: PCT/EP02/07755

§ 371 (c)(1),
(2), (4) Date: Feb. 3, 2004

(87) PCT Pub. No.: WO03/007316

PCT Pub. Date: Jan. 23, 2003

(65) Prior Publication Data

US 2004/0112468 A1 Jun. 17, 2004

(30) Foreign Application Priority Data

Jul. 13, 2001 (DE) ..... 101 34 056

(51) Int. Cl.
*H01F 1/04* (2006.01)

(52) U.S. Cl. ..... 148/108; 148/121; 148/304

(58) Field of Classification Search ..... None
See application file for complete search history.

(56) References Cited

U.S. PATENT DOCUMENTS

| | | | | |
|---|---|---|---|---|
| 2,926,008 | A | 2/1960 | Barnett et al. | |
| 5,261,152 | A | 11/1993 | Simozaki et al. | |
| 5,922,143 | A * | 7/1999 | Verin et al. | 148/108 |
| 6,462,456 | B1 * | 10/2002 | DeCristofaro et al. | 310/216 |

FOREIGN PATENT DOCUMENTS

| | | |
|---|---|---|
| DE | 3324729 | 1/1984 |
| DE | 3237183 | 4/1984 |
| DE | 19635257 | 3/1998 |
| EP | 0299498 | 1/1989 |
| EP | 0429022 | 5/1991 |

OTHER PUBLICATIONS

ASM Materials Engineering Dictionary, Edited by J.R. Davis, Davis & Associates, 1992, p. 2002.*

R. McCurrie, "Ferromagnetic Materials Structure and Properties," Academic Press, pp. 77-78 (1994).

A. Taub, "Effect of the heating rate used during stress relief annealing on the magnetic properties of amorphous alloys," J. Appl. Phys. 55, No. 6, Mar. 15, 1984, pp. 1775-1777.

Abstract of Japanese Patent Publication No. 2000277357, Oct. 6, 2000.

Abstract of Japanese Patent Publication No. 59058813, Apr. 4, 1984.

* cited by examiner

*Primary Examiner*—John P. Sheehan
(74) *Attorney, Agent, or Firm*—Buchanan Ingersoll & Rooney PC

(57) ABSTRACT

The invention relates to a method and to a device for carrying out a manufacturing process in which all magnet cores to be produced are first continuously crystallized. Depending on whether the required hysteresis loops should be round, flat or rectangular, the magnet cores are either immediately finished, that is enclosed in housings, conditioned to a rectangular hysteresis loop in a direct-axis magnetic field or to a flat hysteresis loop in a magnetic cross-field and then finished.

13 Claims, 6 Drawing Sheets

METHOD FOR PRODUCING NANOCRYSTALLINE MAGNET CORES, AND DEVICE FOR CARRYING OUT SAID METHOD

CROSS REFERENCE TO RELATED APPLICATIONS

This application is the U.S. national phase of International Application No. PCT/EP02/07755 filed on Jul. 11, 2002, which claims priority to German Patent Application No. 101 34 056.7 filed on Jul. 13, 2001, the contents of which are hereby incorporated by reference.

BACKGROUND

1. Field

The invention relates to a process for the production of nanocrystalline magnet cores as well as devices for carrying out such a process.

2. Description of Related Art

Nanocrystalline iron-based soft magnetic alloys have been known for a long time and have been described, for example, in EP 0 271 657 B1. The iron-based soft magnetic alloys described there have in general a composition with the formula:

$$(Fe_1\text{-}a\ M_a)_{100\text{-}x\text{-}y\text{-}z\text{-}\alpha}Cu_xSi_yB_zM'_\alpha$$

where M is cobalt and/or nickel, M' is at least one of the elements niobium, tungsten, tantalum, zirconium, hafnium, titanium, and molybdenum, the indices a, x, y, z, and α each satisfy the condition $0 \leqq a \leqq 0.5$; $0.1 \leqq x \leqq 3.0$, $0 \leqq y \leqq 30.0$, $0 \leqq z \leqq 25.0$, $5 \leqq y+z \leqq 30.0$, and $0.1 \leqq \alpha 30$.

Furthermore, the iron-based soft magnetic alloys can also have a composition with the general formula $$(Fe_1\text{-}a\ M_a)_{100\text{-}x\text{-}y\text{-}z\text{-}\alpha\text{-}\beta\text{-}\gamma}Cu_xSi_yB_zM'_\alpha M''_{62}\ X_\gamma$$

where M is cobalt and/or nickel, M' is at least one of the elements niobium, tungsten, tantalum, zirconium, hafnium, titanium, and molybdenum, M" is at least one of the elements vanadium, chromium, manganese, aluminum, an element of the platinum group, scandium, yttrium, a rare earth, gold, zinc, tin, and/or rhenium, and X is at least one of the elements carbon, germanium, phosphorus, gallium, antimony, indium, beryllium, and arsenic and where a, x, y, z, α, β, and γ each satisfy the condition $0 \leqq a \leqq 0.5$, $0.1 \leqq x \leqq 3.0$, $0 \leqq y \leqq 30.0$, $0 \leqq z \leqq 25.0$, $5 \leqq y+z \leqq 30.0$, $0.1 \leqq \alpha \leqq 30.0$, $\beta \leqq 10.0$, and $\gamma \leqq 10.0$.

In both alloy systems at least 50% of the alloy structure is occupied by fine-crystalline particles with an average particle size of 100 nm or less. These soft magnetic nanocrystalline alloys are to an increasing extent used as magnet cores in inductors for the most various applications in electrical engineering. For example, summation current transformers for alternating current-sensitive and also pulse current-sensitive ground fault circuit breakers, chokes and transformers for switched power supplies, current-compensated chokes, filter chokes, or transductors made of strip-wound cores which have been produced from strips made of the nanocrystalline strips described above are known. This follows, for example, from EP 0 299 498 B1. Furthermore, the use of such annular strip-wound cores also for filter sets in telecommunications is known, for example, as interface transceivers in ISDN or also DSL applications.

The nanocrystalline alloys coming into consideration can, for example, be produced economically by means of the so-called quick-hardening technology (for example, by means of melt-spinning or planar-flow casting). Therein an alloy melt is first prepared in which an initially amorphous alloy is subsequently produced by quick quenching from the melted state. The rates of cooling required for the alloy systems coming into consideration above are around $10^6$ K/sec. This is achieved with the aid of the melt spin process in which the melt is injected through a narrow nozzle onto a rapidly rotating cooling roller and in so doing hardened into a thin strip. This process makes possible the continuous production of thin strips and foils in a single operational step directly from the melt at a rate of 10 to 50 m/sec, where strip thicknesses of 20 to 50 μm and strip widths up to ca. several cm. are possible.

The initially amorphous strip produced by means of this quick-hardening technology is then wound to form a geometrically highly variable magnet core, which can be oval, rectangular, or round. The central step in achieving good soft magnetic properties is the "nanocrystallization" of the up to this point amorphous alloy strips. These alloy strips still have, from the soft magnetic point of view, poor properties since they have a relatively high magnetostriction $|\lambda_S|$ of ca. $25\times10^{-6}$. In carrying out a heat treatment for crystallization adapted to the alloy an ultra-fine structure then arises, that is, an alloy structure arises in which at least 50% of the alloy structure is occupied by cubically spatially centered FeSi crystallites. These crystallites are imbedded in an amorphous residual phase of metals and metalloids. The reasons, from the point of view of solid state physics, for the arising of the fine-crystalline structure and the drastic improvement of the soft magnetic properties thus appearing is described, for example, in G. Herzer, IEEE Transactions on Magnetics, 25 (1989), Pages 3327 ff. Thereafter good soft magnetic properties such as a high permeability or low hysteresis losses through averaging out of the crystal anisotropy $K_u$ of the randomly oriented nanocrystalline "structure" arise.

According to the state of the art known from EP 0 271 657 B1or 0 299 498 B1 the amorphous strips are first wound on special winding machines as free from tension as possible to form annular strip-wound cores. For this, the amorphous strip is first wound to form a round annular strip-wound core and, if required, brought into a non-round form by means of suitable forming tools. Through the use of suitable winding elements however, forms can also be achieved directly with winding of the amorphous strips to form annular strip-wound cores which are different from the round form.

Thereafter the annular strip cores, wound free of tension, are, according to the state of the art, subjected to a heat treatment for crystallization which serves to achieve the nanocrystalline structure. Therein the annular strip-wound cores are stacked one over the other and run into such an oven. It has been shown that a decisive disadvantage of this process lies in the fact that by weak magnetic stray fields, such as, for example, the magnetic field of the earth, a positional dependence of the magnetic values is induced in the magnet core stack. While at the edges of the stack for example, there are high permeability values with an intrinsically limited high remanence ratio of more than 60%, the magnetic values in the area of the middle of the stack are characterized by, more or less pronounced, flat hysteresis loops with low values with regard to permeability and remanence.

This is, for example, represented in FIG. 1. FIG. 1*a* shows the distribution of the permeability at a frequency of 50 Herz as a function of the serial number of the cores within an annealing stack. FIG. 1*b* shows the remanence ratio $B_r/B_m$ as a function of the serial number of the cores within an annealing stack. As can be seen from FIGS. 1*a* and 1*b, the* distribution curve for the magnetic values of an annealing production lot is broad and continuous. The distribution curve drops off monotonically at high values. The precise specific curve depends there on the alloy, the magnet core geometry, and naturally the height of the stack.

In the case of the nanocrystalline alloy structures in question the onset of the nanocrystalline structure typically occurs at temperatures of $T_a$—450° C. to 620° C., where the necessary hold times can lie between a few minutes and ca. 12 hours. In particular, it follows from U.S. Pat. No. 5,911,840 that in the case of nanocrystalline magnet cores with a round BH loop a maximal permeability of $\mu_{max}$=760,000 is reached when a stationary temperature plateau, with a duration of 0.1 to 10 hours below the temperature required for the crystallization of 250° C. to 480° C., is used for the relaxation of the magnet cores. This increases the duration of the heat treatment and reduces its economy.

The present invention is based on the discovery that the magnetostatically related formations of parabolas shown in FIGS. 1*a* and 1*b* in the stack annealing of annular strip-wound cores in retort ovens are of a magnetostatic nature and are to be traced back to the location-dependence of the demagnetization factor of a cylinder. Furthermore, it was determined that the exothermic heat of the crystallization process increasing with the core weight can only be released to the environment of the annealing stack incompletely and thus can lead to a clear worsening of the permeability values. It is noted that the nanocrystallization itself is obviously an exothermic physical process. This phenomenon has already been described in JP 03 146 615 A2. The consequence of this insufficient drain of the heat of crystallization is a local overheating of the annular strip-wound cores within the stack which can lead to low permeabilities and to higher remanences. Accordingly, the permeabilities and the remanences of cores in the center of the annealing stack are lower than the permeabilities and the remanences of annular strip-wound cores at the outer edge of the annealing stack. Previously one got around this problem, to the extent that one recognized it at all, by, e.g. as in U.S. Pat. No. 5,911,840, by applying heat, in an uneconomical manner, very slowly in the range of the onset of nanocrystallization, that is, ca. 450° C. Typical heating rates lay in this case between 0.1 and 0.2 K/min, due to which running through the range up to the temperature of 490° C. alone could take up to 7 hours. This method of processing was very uneconomical.

It is thus the objective of the present invention to provide a new process for the production of annular strip-wound cores in which the problem stated initially of dispersion in the form of a parabola and other, in particular exothermically related, worsenings of magnetic indices can be avoided and which works particularly economically.

SUMMARY

According to the invention this objective is realized by a process for the production of annular strip-wound cores of the type stated initially, in which process the finally wound amorphous annular strip-wound cores are heat-treated unstacked in passing to form nanocrystalline annular strip-wound cores.

Through the singling out of the annular strip-wound cores an identical magnetostatic condition for each individual annular strip-wound core is brought about. The consequence of this magnetostatic crystallization condition identical for each individual annular strip-wound core is the elimination of the "parabola effect" shown in FIGS. 1*a* and 1*b* and thus a restriction of the dispersion to alloy-specific, geometrical, and/or thermal causes.

Preferably the heat treatment of the unstacked amorphous annular strip-wound cores is carried out on heat sinks which have a high thermal capacity and a high thermal conductivity, which also is known for JP 03 146 615 A2. Therein a metal or a metallic alloy in particular comes into consideration as material for the heat sinks. In particular, the metals copper, silver, and thermally conductive steel have proven themselves particularly suitable.

Thus, in one embodiment is provided a process for the production of magnetic cores containing an iron-based soft magnetic alloy wherein at least 50% of the alloy structure is occupied by fine-crystalline particles with an average particle size of 100 nm or less with the following steps:

a) preparation of an alloy melt;

b) production of an amorphous alloy strip from the alloy melt by means of quick-hardening technology;

c) winding of the amorphous strip to form amorphous magnet cores;

d) heat treatment of the unstacked amorphous magnet cores in passing to form nanocrystalline magnetic cores.

In another embodiment is provided an oven for carrying out the process described above, having:

a) an oven housing which has at least one annealing zone and one heating zone;

b) means for assembling the annealing zone with unstacked amorphous magnet cores;

c) means for conveying the unstacked amorphous magnet cores through the annealing zone and d) means for withdrawing the unstacked heat-treated nanocrystalline magnet cores from the annealing zone.

DETAILED DESCRIPTION OF SPECIFIC EMBODIMENTS

Figure 1A:
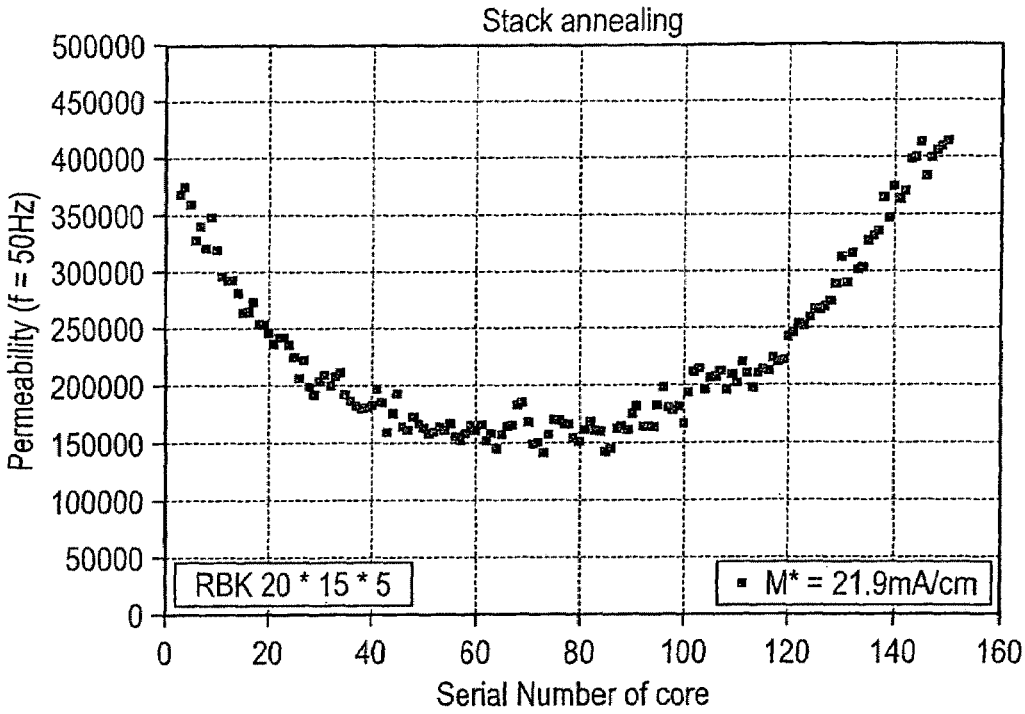
FIG. 1A PRIOR ART
FIG. 1*a* is a graph showing the distribution of magnetic permeability at a frequency of 50 Hz as a function of the number of the cores arranged in series within an annealing stack.

It is however also possible the carry out the heat treatment on a heat sink of ceramics. Furthermore, a development of the present invention is also conceivable in which the amorphous annular strip-wound cores to be treated with heat are mounted in mold bed of ceramic powder or metallic powder, preferably copper powder.

Magnesium dioxide, aluminum oxide, and aluminum nitride have proven themselves particularly suitable as ceramic materials for a solid ceramic plate or for a ceramic powder.

The heat treatment for the crystallization is performed in a temperature range of ca. 450° C. to ca. 620° C., where the heat treatment runs through a temperature window of 450° C. to ca. 500° C. and in so doing is run through at a heating rate of 0.1 K/min to ca. 20 K/min.

The invention is preferably carried out with an oven, where the oven has an oven housing which has at least one annealing zone and one heating zone, means for assembling the annealing zone with unstacked amorphous annular strip-wound cores, means for conveying the unstacked amorphous annular strip-wound cores through the annealing zone, and means for withdrawing the unstacked heat-treated nanocrystalline magnet cores from the annealing zone.

Preferably the annealing zone of such an oven is pressurized with a protective gas.

In a first form of embodiment of the present invention the oven housing has the structure of a tower oven in which the annealing zone runs vertically. The means for conveying the unstacked amorphous annular strip-wound cores through the vertically running annealing zone are in this case preferably a vertically running conveyor belt.

The vertically running conveyor belt has in this case holding surfaces standing perpendicular to the surface of the conveyor belt and made of a material with high heat capacity, that is, either of the metals described initially or the ceramics described initially, which have a high heat capacity and high thermal conductivity. The annular strip-wound cores lie on the holding surfaces in this case.

The vertically running annealing zone is in this case preferably subdivided into several separate heating zones which are provided with separate heating control systems.

In an alternative form of embodiment of the oven according to the invention, it has the structure of a tower oven in which the annealing zone runs horizontally. In this case the horizontally running annealing zone is once again subdivided into several separate heating zones which are provided with separate heating control systems. As means for the conveyance of unstacked amorphous annular strip-wound cores through the horizontally running annealing zone, at least one, but preferably several, holding plates rotating about the axis of the tower oven are provided.

The holding plates once again consist entirely or partially of a material with high heat capacity and high thermal conductivity on which the magnet cores lie. In this case metallic plates come into consideration in particular which consist of the metals stated initially, that is, copper, silver, and thermally conductive steel.

In a third form of embodiment of the oven according to the invention, it has an oven housing which has the structure of a horizontal continuous annealing oven in which the annealing zone one again runs horizontally. This form of embodiment is particularly preferred because such an oven is relatively simple to produce.

In this case, as means for conveying the unstacked amorphous annular strip-wound cores through the horizontally running annealing zone, a conveyor belt is provided, where the conveyor belt is preferably once again provided with holding surfaces which consist of a material with high heat capacity and high thermal conductivity on which the annular strip-wound cores lie. In this case the metallic and/or ceramic materials discussed initially once again come into consideration.

Here too the horizontally running annealing zone once again is typically subdivided into several separate heating zones which are provided with separate heating control systems.

In an extension of the present invention the magnetic cross field treatment required for the generation of the flat hysteresis loops can also be generated directly and simultaneously in passing. For this, at least one part of the passage channel encircled by the oven housing is guided between the two pole shoes of a magnetic yoke so that the passing magnet cores are energized in the axial direction with a homogeneous magnetic field whereby a uniaxial anisotropy transverse to the direction of the wound strip is formed in them. The field strength of the yoke in this case must be so high that the magnet cores are saturated, at least partially, in the axial direction during the heat treatment.

The greater the percentage of the oven channel over which the yoke is laid, the flatter and more linear the hysteresis loops are in this case.

For all three alternative developments of the oven according to the invention the separate heating zones have a first heating zone, a crystallization zone, a second heating zone, and a ripening zone.

The invention is illustrated by way of example in the following with the aid of the drawings. Shown are:

In particular for the production of so-called round hysteresis loops annealing processes are needed which permit the initiation and ripening of an ultrafine nanocrystalline structure under conditions which are as field-free and thermally exact as possible. As mentioned initially, according to the state of the art the annealing is normally carried out in so-called retort ovens in which the magnet cores are run in stacked one over the other.

Figure 1B:
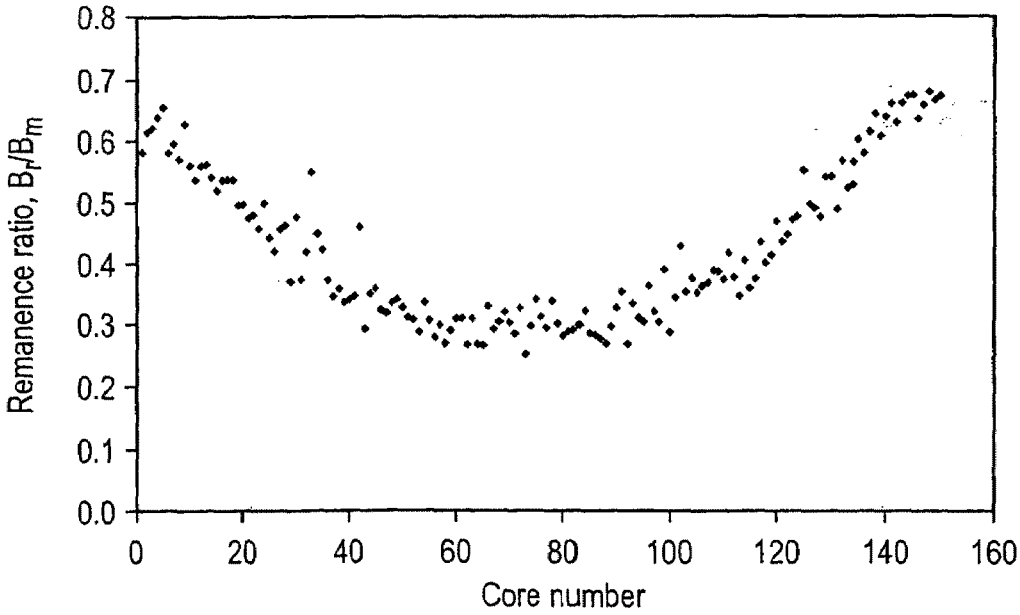
FIG. 1B PRIOR ART
FIG. 1*b* is a graph showing the remanence ratio $B_r/B_m$ as a function of the number of the cores arranged in series within an annealing stack.

The decisive disadvantage of this process is that due to weak stray fields, such as, for example, the magnetic field of the earth or similar stray fields, a positional dependence of the magnetic values is induced in the magnet core stack. This can be called the antenna effect. While at the edges of the stack for example, there are actually round loops with high permeability values with an intrinsically limited high remanence ratio of more than 60%, in the area of the middle of the stack there are more or less pronounced, flat hysteresis loops with low values with regard to permeability and remanence. This was shown initially in FIGS. 1*a* and 1*b*.

Accordingly the distribution curve of the magnetic characteristic values for a production lot is broad, continuous, and drops off monotonically at high values. As mentioned initially the precise curve depends on the soft magnetic alloy used in the particular case, the geometry of the magnet core, and the stack height.

Along with the magnetostatically related parabola formation, stack annealing in retort ovens has the further disadvantage that with increasing core weight the exothermic heat of the crystallization process can only be released to the environment incompletely. The consequence is a local overheating of the stacked magnet cores which can lead to low permeabilities and to higher coercive field strengths. To get around this problem heat was applied very slowly in the range of the onset of crystallization, that is, ca. 450° C., which is uneconomical. Typical heating rates lay in this case between 0.1 and 0.2 K/min, due to which running through the range up to the temperature of 490° C. alone could take up to 7 hours.

The single economically realizable, large-scale industrial alternative to stack annealing in retort ovens lies in a continuous annealing according to the present invention. Through the singling out of the magnet cores by the continuous processing, identical magnetostatic conditions for each individual magnet core are provided. The consequence is the elimination of the parabola effect described above which [limits] the dispersion to alloy-specific, core-technological, and thermal causes.

Figure 2:
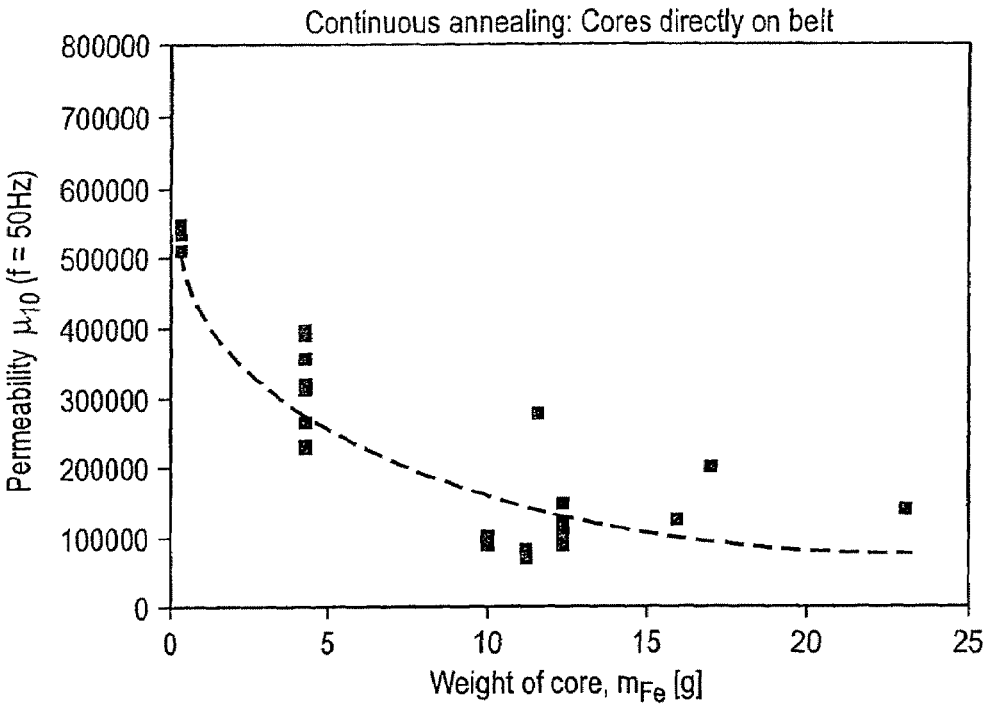
FIG. 2 is a graph showing the effect of the weight of an annular strip wound core on the permeability (at a frequency of 50 Hz) of annular strip-wound cores that are continuously annealed without the presence of a heat sink.

While the first two factors can be well controlled, the rapid heating rate typical for continuous annealing can itself lead to an exothermic development of heat for individual magnet cores, said exothermic development of heat having, according to FIG. 2, a negative effect on the magnetic properties increasing with core weight. FIG. 2 shows the effect of the weight of the magnet core ($\mu_{10} \approx \mu_{max}$) if the magnet cores are heat-treated directly in passing without a heat sink.

Figure 3:
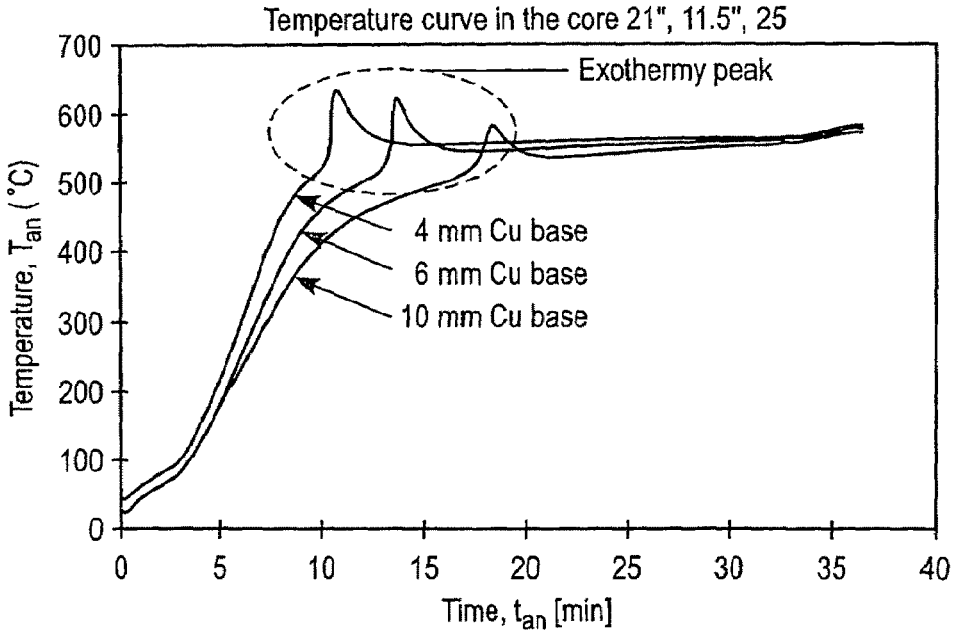
FIG. 3 is a time-temperature diagram showing the effect of the presence of heat sinks of varying thicknesses on the exothermic crystallization behavior of continuously annealed strip-wound cores in an embodiment of the process disclosed herein.

Since a delayed heating would lead to an uneconomical multiplication of the length of the passage section, this problem can be solved by the introduction of heat-absorbing bases (heat sinks) made of metals which conduct heat well or by metallic or ceramic powder beds. Copper plates have proven themselves to be particularly suitable since they have a high specific heat capacity and a very good thermal conductivity. Thereby the exothermically generated heat of crystallization can be withdrawn from the magnet cores on the apical side. Moreover, heat sinks of this type reduce the heating rate whereby the exothermic excess temperature can be further limited. This is illustrated by FIG. 3. FIG. 3 shows the effect of copper heat sinks of different thicknesses on the exothermy behavior in annular strip-wound cores which have dimensions of approximately 21×11.5×25 mm.

Since the rate of temperature compensation depends on the temperature difference between the magnet core and heat sink, its heat capacity is to be adapted via the thickness to the mass and the height of the magnet core.

Figure 4:
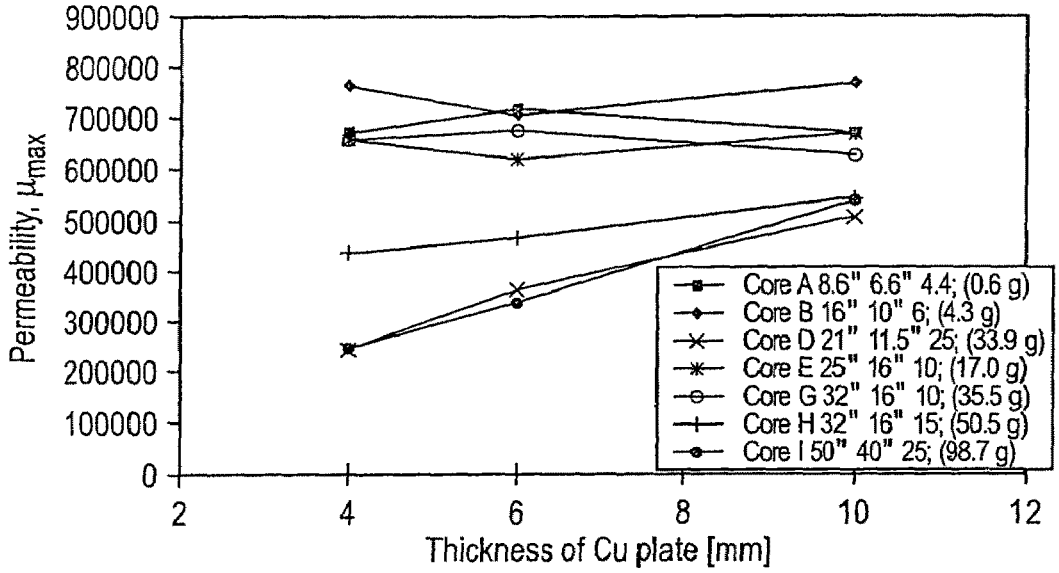
FIG. 4 is a graph showing the effect of heat sinks of various thicknesses on the maximal permeability of continuously annealed annular strip-wound cores of different geometry and different annular strip-wound core mass in an embodiment of the process disclosed herein.

FIG. 4 shows the effect of the thickness of the heat sinks on the maximal permeability of annular strip-wound cores of different geometries or magnet core masses. While according to FIG. 4 for magnet cores with low core weight and/or smaller magnet core height a 4-mm-thick copper heat sink already leads to good magnetic characteristic values, heavier or higher magnet cores need thicker heat sinks with a higher heat capacity. The empirical rule of thumb has developed that the plate thickness d should be $\geqq 0.4\times$ the core height h.

Figure 5:
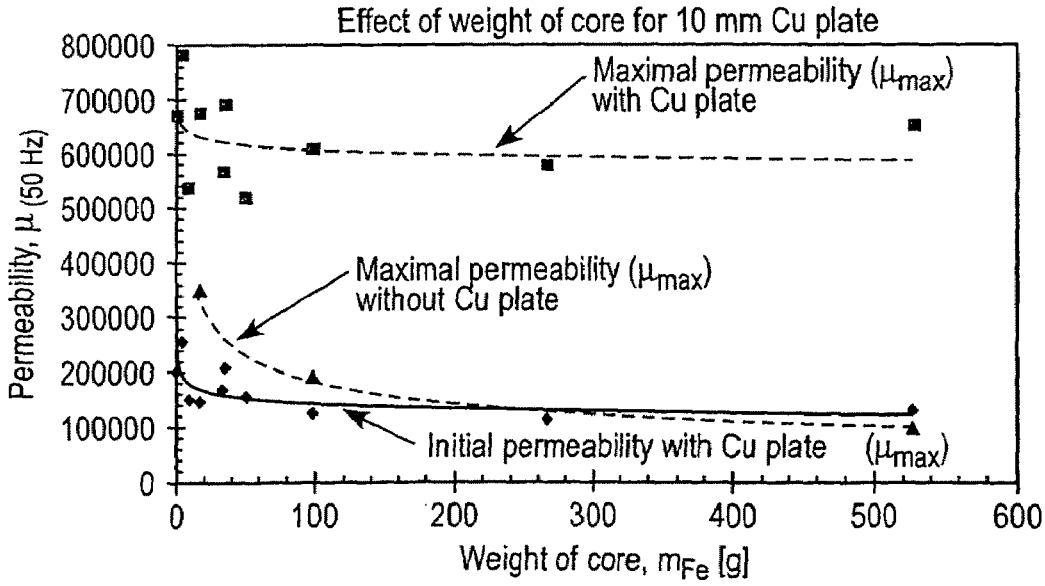
FIG. 5 is a graph showing the effect of the weight of the annular strip-wound core on the permeability (at a frequency of 50 Hz) after continuous annealing on a 10 mm thick copper heat sink in an embodiment of the process disclosed herein.

As follows from FIG. 5, outstanding magnetic characteristic values ($\mu_{max}$(50 Hz)$\geqq$500,000, $\mu_1$>100,000) can be achieved over a wide range of weight taking this rule into account.

Figure 6:
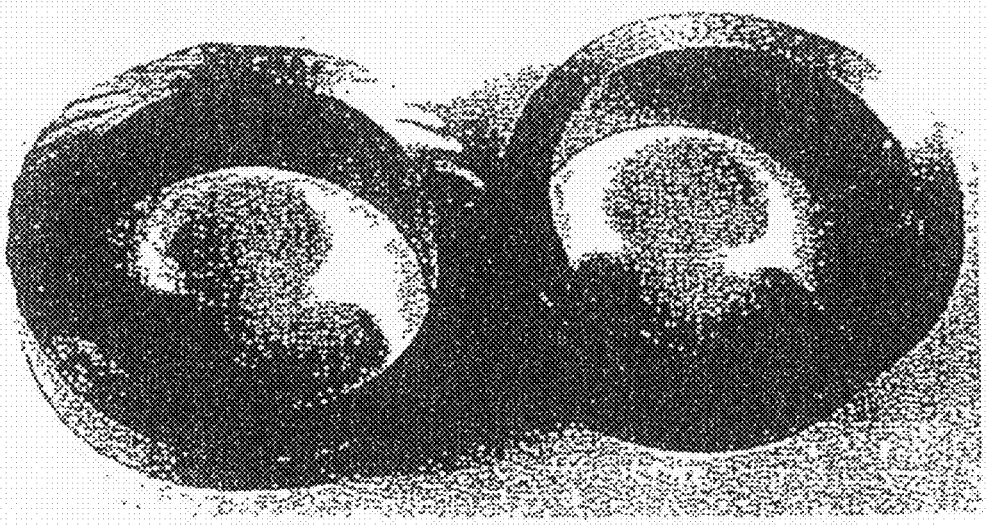
FIG. 6 is photograph showing the apical faces of two annular strip-wound cores after a continuous annealing with and without a heat sink.

The lowering of the magnetic properties in continuous annealing without heat sinks is usually connected with warps and bends in the form of lamellas in the strip seats, which follows from FIG. 6. FIG. 6 shows the apical faces of two annular strip-wound cores with the dimensions 50×40×25 $mm^3$ after a continuous annealing without a heat sink (left core) and on 10-mm-thick copper heat sink (right core). For the right core practically no warps occurred on the apical side. For the left magnet core on the contrary the maximal permeability was $\mu_{max}$–127,000 where it was on the contrary approximately 620,000 for the right magnet core.

It has been shown that only when more than ca. 85% of the apical face of a core is free of warping can good magnetic characteristic values also be achieved.

Figure 7:
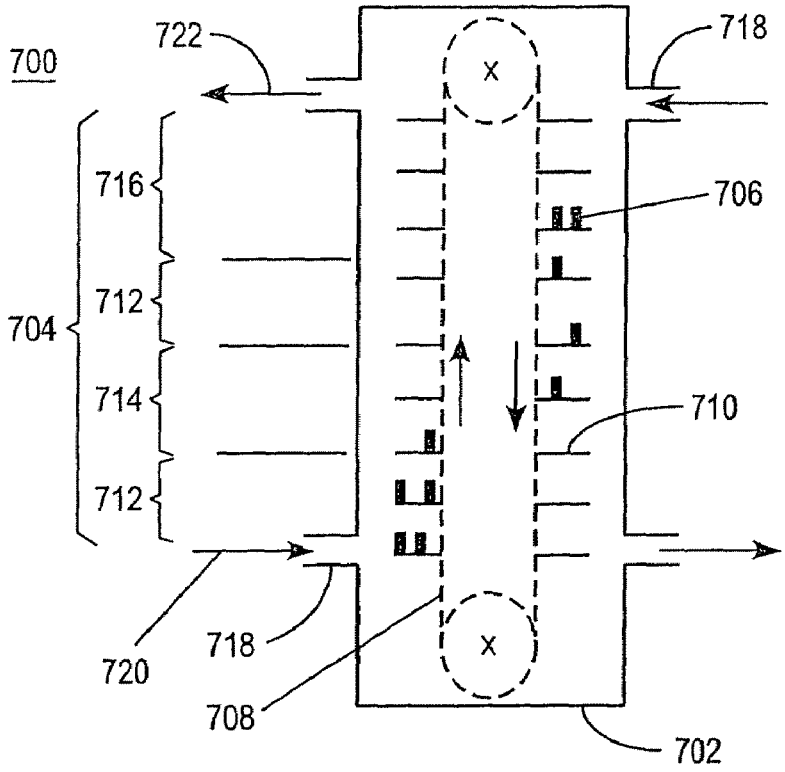
FIG. 7 is a schematic diagram of a tower oven according to an embodiment disclosed herein, and having a vertically running conveyor belt.

FIG. 7 shows schematically a first form of embodiment of the present invention, a so-called tower oven 700. The tower oven 700 has in this case an oven housing 702 in which the annealing zone 704 runs vertically, e.g., with a reducing or passive protective gas. The unstacked amorphous magnet cores being annealed 706 are in this case conveyed through a vertically running annealing zone 704 by a vertically running conveyor or transport belt 708.

The vertically running conveyor belt 708 has in this case holding surfaces 710, e.g., holding surfaces having thermal ballast or heat absorbing bases, e.g., with latch fastening, standing perpendicular to the surface of the conveyor belt 708. These holding surfaces are desirably made of a material with high heat capacity and/or thermal conductivity, preferably copper. The annular strip-wound magnetic cores 706 in this case desirably lie with their apical faces on the holding surfaces 710. The vertically running annealing zone 704 is in this case subdivided into several heating zones 712, a crystallization zone 714, and a ripening zone 716. The heating zones are provided with separate heating control systems. A reducing or passive protective gas can be introduced through locks 718. The magnetic cores to be annealed can be introduced into the oven at 720 and withdrawn from the oven at 722.

Figure 8:
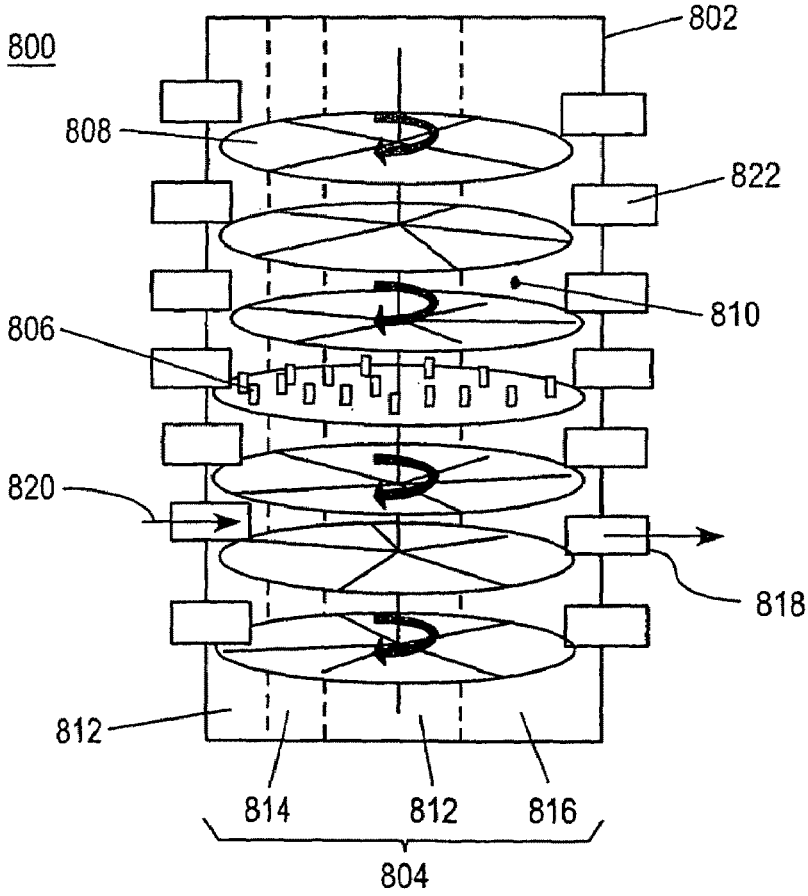
FIG. 8 is a schematic diagram of a multi-stage carousel oven according to an embodiment disclosed herein.

In FIG. 8 an additional form of embodiment of the present invention is illustrated. Also here the structure of the oven is once again that of a tower oven 800 having an oven housing 802 which encloses an oven space 810, desirably with a reducing or passive protective gas, and in which the annealing zone 804 however runs horizontally. In this case the horizontally running annealing zone 804 is once again subdivided into several separate heating zones 812 which are provided with separate heating control systems, and which include a crystallization zone 814 and a ripening zone 816. As means for the conveyance of unstacked amorphous annular strip-wound cores 806 through the horizontally running annealing zone 804 once again one, but preferably several, holding plates 808, rotating about the axis of the tower oven are provided which serve as heat sinks, thermal ballast, or heat absorbing bases. The unstacked amorphous magnet cores 806 can be introduced to the oven through lock 820 and the annealed magnet cores can be passed through cooling zone and removed through port 818. One or more locks 822 for introducing or removing reducing or passive protective gas can be provided in the oven 800.

The holding plates 808 once again consist entirely or partially of a material with high heat capacity and high thermal conductivity on which the magnet cores 806 lie with their apical faces.

Figure 9:
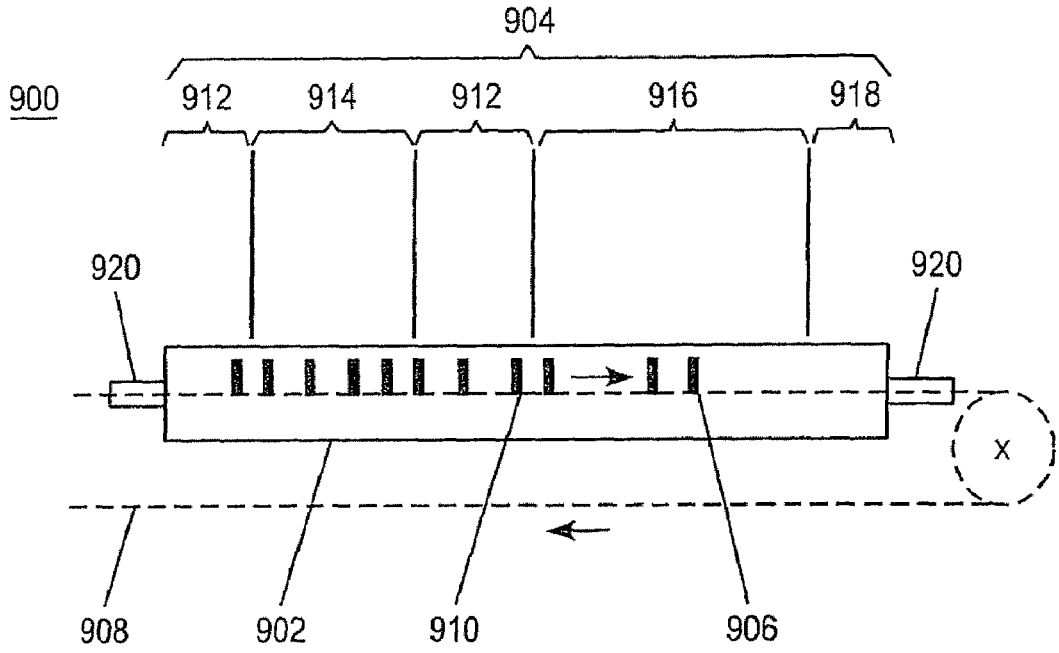
FIG. 9 is a schematic diagram of a horizontal continuous annealing oven according to an embodiment disclosed herein, and having a horizontally running conveyor belt.

FIG. 9 finally shows a third particularly preferred alternative form of embodiment of the present invention in which the oven housing 902 has the structure of a horizontal continuous annealing oven 900. In this case the annealing zone 904 once again runs horizontally. This form of embodiment is particularly preferred because such an oven can be produced with less effort than the two ovens mentioned above.

In this case the annular strip-wound cores 906 are conveyed through the horizontally running annealing zone 904 (desirably in the presence of a reducing or passive protective gas) via a conveyor belt 908, where the conveyor belt 908 is preferably once again provided with holding plates 910 which serve as heat sinks or thermal ballast or heat absorbing bases. Once again copper plates are particularly preferred here. In an alternative development of the transport, holding plates 910 can be heat sinks which slide on rollers through the oven housing 902.

As follows from FIG. 9, the horizontally running annealing zone 904 is once again subdivided into several separate heating zones 912, which are provided with separate heating control systems, and into a crystallization zone 914, ripening zone 916, and cooling zone 918. Introduction and withdrawal of the magnetic cores 906 can be done through rinsing zones 920 with reducing or passive protective gas.

Figure 10:
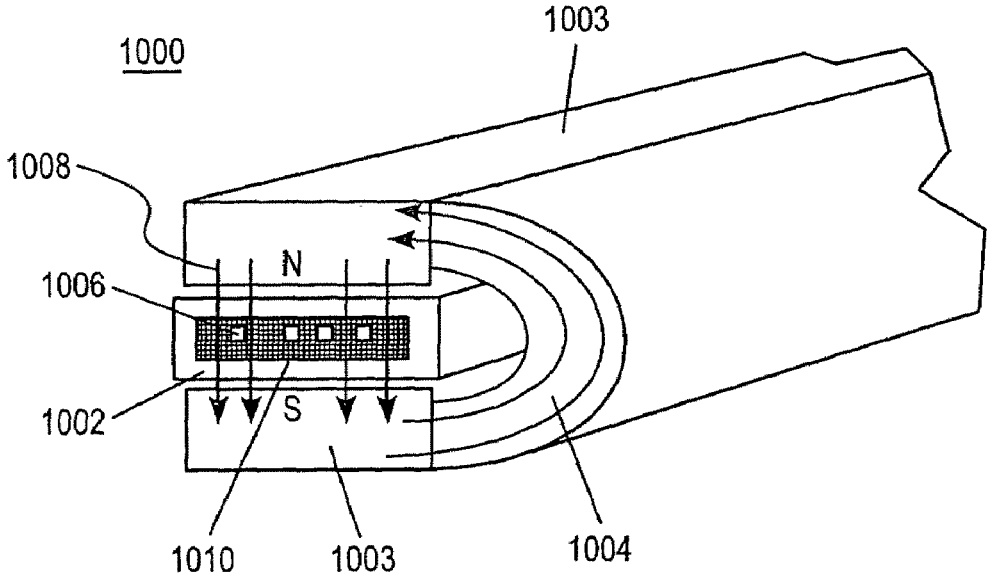
FIG. 10 is a schematic diagram of a transverse field arrangement for a continuous annealing oven, where transverse field generation is by means of a yoke over the oven channel.

In the case of a special form of embodiment of the horizontal continuous annealing oven shown in FIG. 9, the magnetic cross field treatment required for the generation of the flat hysteresis loops can be generated directly in passing. The device 1000 required for this is shown in FIG. 10. For this, at least one part of the heating or passage channel 1002 of the oven is guided between the two pole shoes 1003 of a yoke 1004 so that the passing magnet cores 1006 are energized in the axial direction with a homogeneous magnetic field 1008 whereby a uniaxial anisotropy transverse to the direction of the wound strip is formed in them. The field strength of the yoke 1004 in this case must be so high that the magnet cores 1006 are saturated, at least partially, in the axial direction during the heat treatment. The magnetic 1006 cores may be moved through heating channel 1002 on a holding surface 1010, again having a thermal ballast, heat sink, or heat absorbing base, such as copper.

The greater the percentage of the oven channel over which the yoke is laid, the flatter and more linear the hysteresis loops are in this case.

With these measures the following results were achieved:

For a field strength of 0.3 T, which was effective between the pole shoes of the yoke which [lay] along the entire heating interval, magnet cores with the dimensions 21 mm×11.5 mm×25 mm and the composition $Fe_{ba1}Cu_{1.0}Si_{15.62}B_{6.85}Nb_{2.98}$ were produced which have permeability values of ca. μ=23,000(f=50 Hz). The remanence was reduced as a consequence of the action of the axial field to 5.6%.

On allocation of only half of the heating interval the uniaxial anisotropy remained weaker and the hysteresis loop was less flat.

In the tempering without magnetic yoke the remanence ratio in comparison thereto was around or above 50% and the permeability curve as a function of the field strength corresponded to that of round hysteresis loops.

With the process according to the invention, and the devices, a new, large-scale, industrial production pathway can be applied by all magnet cores present being crystallized initially in passing. According to whether the required hysteresis loops are supposed to be round, flat, or rectangular, these magnet cores are subsequently either immediately subjected to final processing, i.e. caught in the housing, retempered in a magnetic longitudinal field to form a rectangular hysteresis loop, or retempered in a magnetic cross field to form a flat hysteresis loop and only then subjected to final processing.

Unlike the customary processes the cores can be produced essentially more quickly and in a significantly more economical manner.

The invention claimed is:

1. Process for the production of a plurality of magnet cores comprising an iron-based soft magnetic alloy wherein at least 50% of the alloy structure is occupied by fine crystallites with an average crystallite size of 100 nm or less, comprising:

a) preparing a melt of an iron-based alloy;

b) producing an amorphous alloy strip from the alloy melt by quickly quenching the alloy from the melted state;

c) forming a plurality of unstacked amorphous magnet cores by winding one or more amorphous strips; and d) heat treating the plurality of unstacked amorphous magnet cores, comprising:

conveying each of the plurality of unstacked magnet cores through an annealing zone in a continuous fashion;

providing each individual core with identical magnetostatic conditions; and withdrawing any exothermically generated heat of crystallization from the magnet cores through one or more heat absorbing bases having a high thermal capacity and a high thermal conductivity;

to form nanocrystalline magnet cores.

2. Process according to claim 1, wherein the heat absorbing bases comprise a metal.

3. Process according to claim 2, wherein the metal comprises copper, silver, or thermally conductive steel.

4. Process according to claim 1, wherein the heat absorbing bases comprise a ceramic.

5. Process according to claim 4, wherein the ceramic comprises magnesium dioxide, aluminum oxide, or aluminum nitride.

6. Process according to claim 1, wherein the heat treating is performed in a temperature range of about 450° C. to about 620° C.

7. Process according to claim 6, wherein the heat treating runs through a temperature window of about 450° C. to about 500° C.

8. Process according to claim 7, wherein the temperature window is run through at a heating rate of 0.1 K/min to about 20 K/min.

9. Process according to claim 2, wherein the metal comprises a metal alloy or a metal powder.

10. Process according to claim 4, wherein the ceramic comprises a ceramic powder.

11. Process according to claim 1, wherein the heat absorbing base comprises a mold bed of ceramic powder or metallic powder.

12. Process according to claim 1, further comprising exposing the magnet cores to a sufficient transverse magnetic field to form a homogeneous magnetic field transverse to the direction of the wound strip.

13. Process according to claim 12, wherein said exposing comprises passing the magnet cores through two pole shoes of a magnetic yoke.

* * * * *